US005884907A

United States Patent [19]

Ohkoda

[11] Patent Number: 5,884,907

[45] Date of Patent: Mar. 23, 1999

[54] SUCTION DEVICE AND RECORDING/ READING APPARATUS

[75] Inventor: Keiji Ohkoda, Yokohama, Japan

[73] Assignee: Canon Kabushiki Kaisha, Tokyo, Japan

[21] Appl. No.: 954,878

[22] Filed: Oct. 21, 1997

Related U.S. Application Data

[63] Continuation of Ser. No. 397,870, Mar. 2, 1995, abandoned.

[30] Foreign Application Priority Data

Mar. 10, 1994 [JP] Japan ..... 6-039858

[51] Int. Cl.[6] ..... B65H 3/08

[52] U.S. Cl. ..... 271/90; 271/91; 271/107; 271/108; 271/110; 271/112

[58] Field of Search ..... 271/90, 91, 107, 271/108, 110, 112; 294/64.1, 65; 355/312; 92/34; 417/472; 414/797

[56] References Cited

U.S. PATENT DOCUMENTS

| | | | |
|---|---|---|---|
| 3,980,292 | 9/1976 | Sakurai | 271/107 |
| 4,580,773 | 4/1986 | Minkle | 271/107 |
| 4,968,019 | 11/1990 | Tanabe et al. | 271/107 |
| 5,041,879 | 8/1991 | Akao et al. | 271/107 |
| 5,064,183 | 11/1991 | Nishigaki et al. | 294/64.1 |
| 5,094,439 | 3/1992 | Renner et al. | 271/107 |
| 5,097,496 | 3/1992 | Madate | 271/107 |
| 5,253,858 | 10/1993 | Grieve | 271/107 |

FOREIGN PATENT DOCUMENTS 60118550 6/1985 Japan .

*Primary Examiner*—Karen M. Young
*Assistant Examiner*—Douglas Hess
*Attorney, Agent, or Firm*—Fitzpatrick, Cella, Harper & Scinto

[57] ABSTRACT

A recording/reading apparatus includes a recording/reading device for recording or reading information on sheets, a suction cup for picking up an object by suction, with the suction cup having an air outlet hole, a container having an inner space that is closed except for an opening for connection with the air outlet hole. The container has a flexible portion, and the volume of the inner space is variable through deformation of the flexible portion. Also provided is a driving device for deformation-driving of the container and a hollow member for connecting the opening for connection with the air outlet hole of the suction cup.

29 Claims, 10 Drawing Sheets

SUCTION DEVICE AND RECORDING/ READING APPARATUS

This application is a continuation of application Ser. No. 08/397,870, filed Mar. 2, 1995, now abandoned.

BACKGROUND OF THE INVENTION

1. Field of the Invention

The present invention relates to a recording/reading apparatus and a suction device that can be effectively used therein. The present invention is satisfactorily applicable, for example, to a sheet feeding device for feeding sheets to an image recording apparatus, an image reading apparatus or the like. Further, the present invention is applicable to a recording/reading apparatus that records images on sheets fed by such a feeding device or reads images from the sheets.

2. Description of the Related Art

Sheet feeding devices have been used in various apparatuses including image recording apparatuses and image reading apparatuses. There are various known structures and mechanisms of such sheet feeding devices. There are various types of means for realizing the function of a sheet feeding device by which sheets can be extracted one by one from a number of sheets stacked together. In many cases in which sheets of paper are to be fed, rubber rollers are used to extract the sheets one by one. When the sheets consist of films, static electricity is liable to be generated due to the smaller degree of surface roughness as compared with that of paper sheets, with the result that the sheets that are stacked together are attracted to each other by a greater force. In view of this, a suction cup is often used. By reducing the inner pressure of the suction cup, sheets can be taken one by one off the pile.

FIG. 1 schematically shows the construction of a device for reducing the inner pressure of a suction cup to pick up sheets by suction. In FIG. 1, numeral 81 indicates a suction cup having a hole 81*a* formed for the purpose of expelling air from the suction cup. This hole is connected to a hose 82*a*. The other end of the hose 82*a* is joined to an electromagnetic valve 83. The other end of the electromagnetic valve 83 is connected to an electromagnetic pump 84 through a hose 82*b*. A diaphragm 85 that is made of rubber, shown in FIG. 2, is provided inside the electromagnetic pump 84. The diaphragm 85 has a central portion 85*a* which is repeatedly moved back and forth at high speed by an electromagnetic force generating means (not shown). The diaphragm 85 is fitted onto a base 86, which has an air inlet hole 86*a*, an air outlet hole 86*b*, and one-way valves 87 and 88. The hose 82*b* is connected to the air inlet hole 86*a* of the diaphragm 85 inside the electromagnetic pump 84. Thus, the gas drawn in through the air inlet hole 86*a* as a result of the back-and-forth movement of the diaphragm 85 is expelled through the air outlet hole 86*b*, whereby the pressure in the device portion that is connected to the air inlet hole 86*a* can be reduced.

In the above-described construction, when a sheet is to be picked up by suction, the suction cup 81 is pressed against the sheet, and the electromagnetic valve 83 is closed. Then, the electromagnetic pump 84 is operated. The operation of the electromagnetic pump 84 is continued throughout the sucking up of the sheet. When the sucking action is to be cancelled, the electromagnetic valve 83 is opened, and the electromagnetic pump 84 is stopped. The reason for using an electromagnetic valve is to draw in air quickly to thereby speedily cancel the sucking action.

Apart from the diaphragm type electromagnetic type shown in the drawing, there are various other types of electromagnetic pumps applicable. In some cases, a centrifugal pump as shown in FIG. 3 is used. In FIG. 3, numeral 90 indicates an impeller, and numeral 89 indicates a body having an air inlet hole 89*a* and an air outlet hole 89*b*.

According to a known method, a sheet can be picked up by suction by using an air cylinder as shown in FIG. 4, (Japanese Patent Laid-Open No. 60-118550). According to another known method, a suction cup is first deformed and then restored to its original shape by a restoring force of the suction cup itself, as shown in FIG. 5, whereby a sheet can be picked up. In FIG. 4, numeral 91 indicates an outer cylinder to which a hose 93 is joined. Numeral 92 indicates an inner cylinder which can be moved to the right and left (as seen in the drawing) to thereby increase and decrease the volume of the interior while keeping the interior airtight with respect to the inner wall of the outer cylinder 91. A suction cup is joined to the forward end of the hose 93 and pressed against a sheet. In this condition, when the inner cylinder 92 is pulled, the pressure of the interior is reduced, thereby enabling the sheet to be picked up by suction. In the case of FIG. 5, a suction cup 94 having no air outlet hole is used. When the suction cup 94 is pressed against a sheet, a cone-shaped section 94*a* of the suction cup 94 is deformed, and, due to the restoring force of this deformed section 94*a*, a reduction in the pressure of the interior of the suction cup 94 occurs to thereby pick up the sheet by suction.

The above-described conventional mechanisms, however, have the following problems:

1. Since the electromagnetic pump continues to be driven while the sheet is being picked up by suction, a noise continues to be generated from the pump, so that the device is rather noisy.
2. Since the electromagnetic pump continues to be driven while the sheet is being picked up by suction, a vibration continues to be generated from the pump, thereby causing a deterioration in the performance of the device. On the other hand, provision of a vibration isolator would result in an increase in cost.
3. The electromagnetic valve and the electromagnetic pump are rather expensive and lead to a rather high cost.
4. When a rubber member of low durability is used in the movable section of the electromagnetic pump, a periodical replacement of this rubber member is required, resulting in an increase in running cost.
5. In the case of the cylinder type device, it is necessary to maintain the requisite airtightness in the slide section, which means this type of device involves problems in terms of manufacturing precision and durability.
6. In the type of device utilizing the deformation of the suction cup, no good method is available for cancelling the sucking action.

SUMMARY OF THE INVENTION

The present invention has been made with a view toward solving the above problems in the prior art. Thus, it is an object of the present invention to provide an inexpensive suction device of low noise and low vibration, and a recording/reading apparatus using such a suction device.

Other objects of the present invention will be apparent from the following description of embodiments.

DESCRIPTION OF THE PREFERRED EMBODIMENTS

In this specification, an "inner space closed except for an opening for connection with an air outlet hole" is described. This is a space where no portion of which is connected with the exterior, regardless of whether an electromagnetic valve or the like is provided between this inner space and the exterior.

Embodiments of the present invention will now be described in detail with reference to FIGS. 6 through 13.

Figure 1:
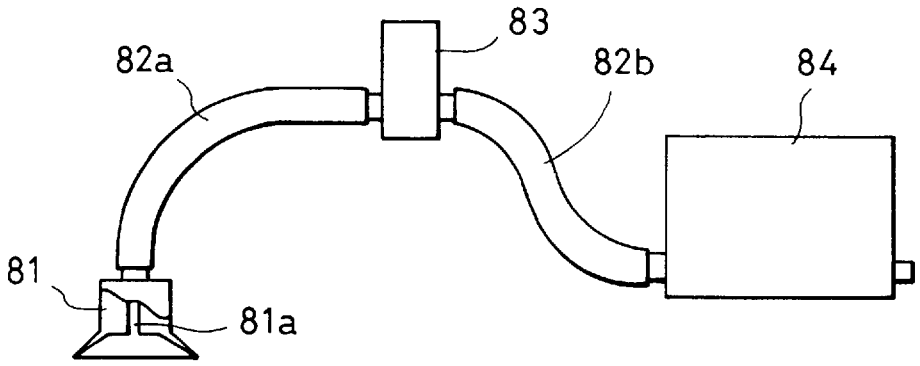
FIG. 1 is a diagram illustrating a conventional suction device.
Figure 2:
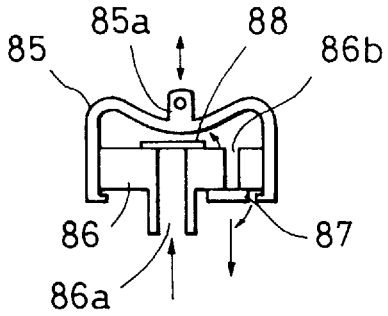
FIG. 2 illustrates a diaphragm in a pump of a conventional suction device.
Figure 3:
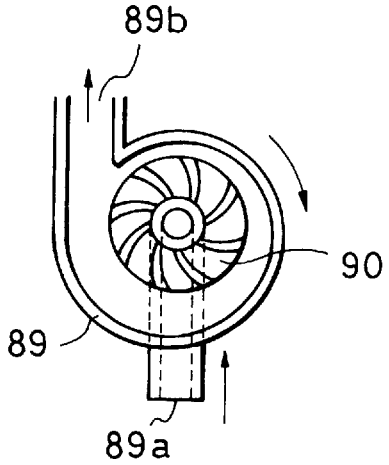
FIG. 3 illustrates a centrifugal pump in a conventional suction device.
Figure 4:
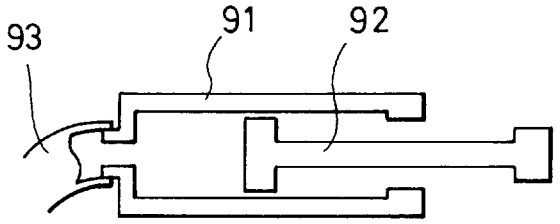
FIG. 4 illustrates an air cylinder in a conventional suction device.
Figure 5:
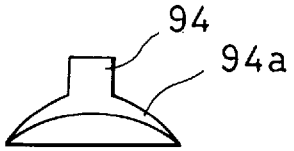
FIG. 5 is a diagram illustrating a suction cup in a conventional suction device.
Figure 6:
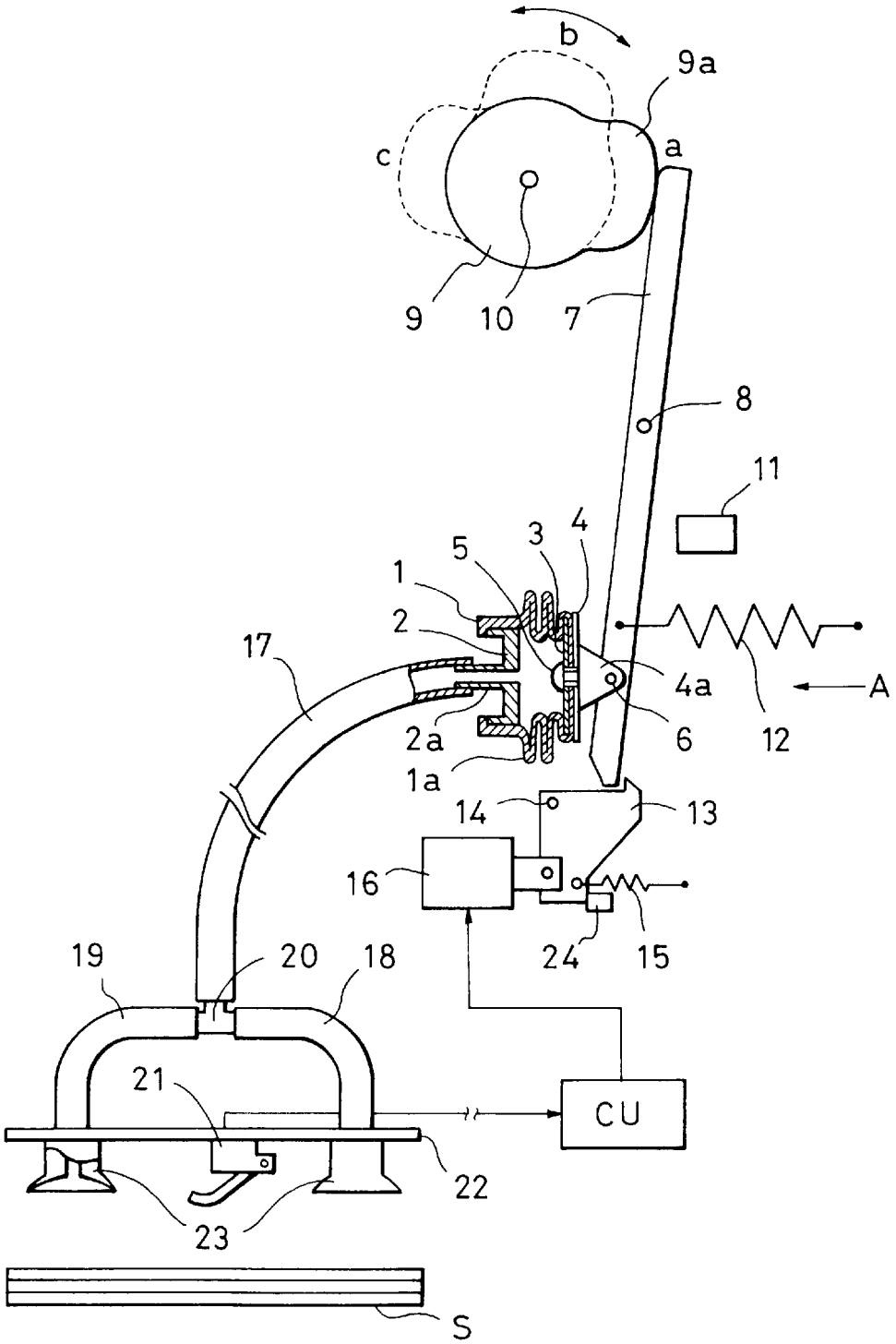
FIG. 6 shows a plan view of a pressure reducing mechanism section, and a front view of a suction cup section, of a first embodiment of the present invention.
Figure 7:
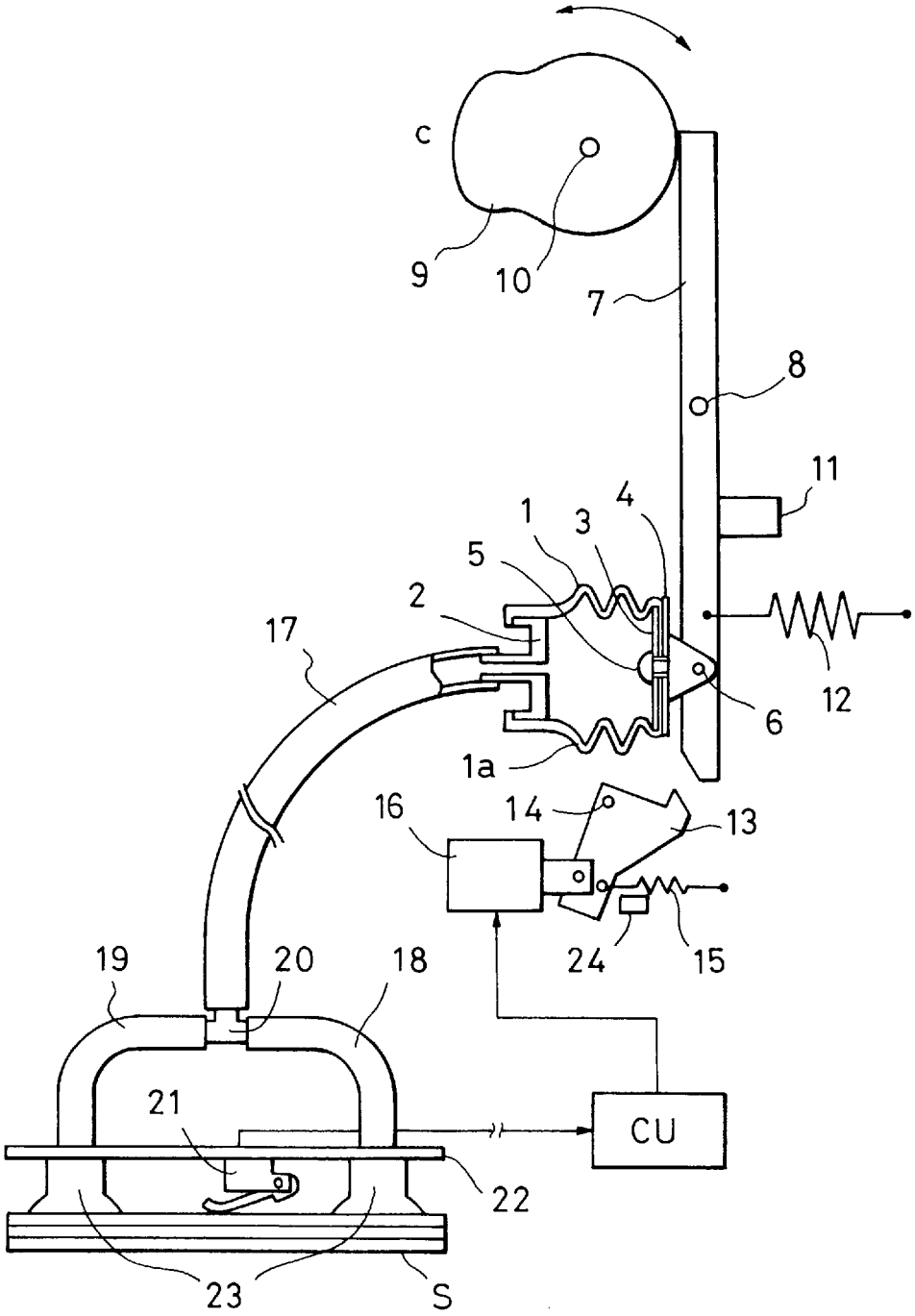
FIG. 7 shows a plan view of the pressure reducing mechanism section, and a front view of the suction cup section, of the first embodiment of the present invention.

FIG. 6 shows a plan view of a pressure reducing mechanism section, and a front view of a suction cup section, of the first embodiment. FIG. 7 is a diagram showing the operating condition at a different point in time of the same mechanism.

The structure of the mechanism will be described with reference to FIGS. 6 and 7. Numeral 1 indicates a rubber diaphragm having an extendable bellows section 1*a*. In the drawings, the diaphragm 1 is shown in section. When seen in the direction of the arrow A, the rubber diaphragm exhibits a circular configuration. Numeral 2 indicates a base to which the diaphragm 1 is attached. The base 2 has, in its central portion, a pipe section 2*a* by means of which the base 2 can be connected to a hose 17. The inner diameter of the diaphragm 1 is smaller than the outer diameter of the base 2, so that the contact section between the diaphragm 1 and the base 2 is kept airtight. The base 2 is secured to a frame (not shown). Numeral 3 indicates a circular plate, and numeral 4 indicates a connecting member having a section 4*a* by means of which the circular plate 3 can be connected with a lever 7. The connecting member 4 holds the right-hand-end (as seen in the drawing) plate of the diaphragm 1 and is fastened thereto by a screw 5. The reason for this arrangement is to prevent the end surface from being deformed through the expansion and contraction of the diaphragm. Numeral 6 indicates an axle connecting the lever 7 with the member 4. The lever 7 is secured to a frame (not shown) in such a way as to be rotatable around an axle of rotation 8. Numeral 9 indicates a cam for moving the lever 7. The cam 9 rotates around a drive shaft 10. An extension spring 12 is attached to the lever 7, thereby biasing the lever 7 counterclockwise. Numeral 11 indicates a stopper for restricting the range of rotation of the lever 7. Numeral 13 indicates a lock lever, which is fixed in such a way as to be rotatable around an axle 14 and is biased counterclockwise by an extension spring 15. Numeral 16 indicates a solenoid which, when energized, can rotate the lock lever 13 clockwise against the biasing force of the extension spring 15. Numeral 24 indicates a stopper for restricting the range of rotation of the lock lever 13. The hose 17 is connected to hoses 18 and 19 through the intermediation of a joint pipe 20. Suction cups 23 are attached to the forward ends of the hoses 18 and 19. Numeral 22 indicates a suction cup holding member for holding the suction cups and allowing them to move. Numeral 21 indicates a photointerrupter attached to the suction cup holding member 22 and equipped with an actuator. Symbol CU indicates a control unit, and symbol S indicates a stack of sheets (which, in this example, consist of photographic films). The suction cups 23 are caused to move toward and away from the pile of sheets S by a moving mechanism (not shown). In this embodiment, the moving mechanism for moving the suction cups and the drive shaft of the cam 9 share the same drive source. Driving force is transmitted from this source to the drive shaft of the cam 9. Thus, the moving mechanism for moving the suction cups and the drive shaft of the cam 9 are operationally linked together. In the condition of FIG. 6, in which the suction cups 23 are spaced apart from the sheets, a protrusion 9*a* of the cam is at a position indicated by symbol a. As the suction cups 23 move toward the position shown in FIG. 7, the protrusion 9*a* of the cam is brought to position c by way of position b.

Next, the operation of this mechanism will be described with reference to FIGS. 6 and 7. As stated above, FIG. 6 shows the condition in which the suction cups are separated from the sheets S. In this condition, the protrusion 9*a* of the cam 9 urges the lever 7 to pull the spring 12, thereby causing the bellows section 1*a* of the diaphragm 1 to contract. In this condition, the lower end of the lever 7 is in a condition in which it can move over the lock lever 13 to effect locking. Then, the suction cups 23 approach the pile of sheets, and, simultaneously with this movement, the protrusion 9*a* of the cam 9 is brought to position c by way of position b. At this time, the lever 7 is engaged with the lock lever 13, so that it is maintained in its position shown in FIG. 6. Therefore, the bellows section la of the diaphragm 1 contracts, and the spring 12 remains in the expanded state. Next, when the suction cups 23 are brought into contact with the stack of sheets S and squeezed flat thereon, a signal is generated from the photointerrupter 21. This signal serves as a trigger to cause the solenoid 16 to be energized by the control unit CU. Then, as shown in FIG. 7, the engagement of the lock lever 13 is released, and the lever 7 rotates counterclockwise until it abuts the stopper 11. As a result of this operation, the bellows section 1*a* is expanded, and the inner volume thereof increases, with the result that the inner pressure thereof decreases, thereby causing a sheet S to be picked up by suction. After the movement of the lever 7, the energization of the solenoid 16 is stopped. As the suction cups 23 are moved away, the sheet thus picked up is separated from the remaining sheets. Simultaneously with this movement, the protrusion 9*a* of the cam 9 rotates clockwise from position c. At the point in time when the sheet sucking action is to be cancelled, the protrusion 9*a* urges the lever 7 to contract the diaphragm 1. When the lower end of the lever 7 pushes the lock lever 13 downward and reaches the position of FIG. 6, the protrusion 9*a* reaches position a, thereby restoring the mechanism to the initial state. This operation is repeated to perform sheet feeding.

Figure 8:
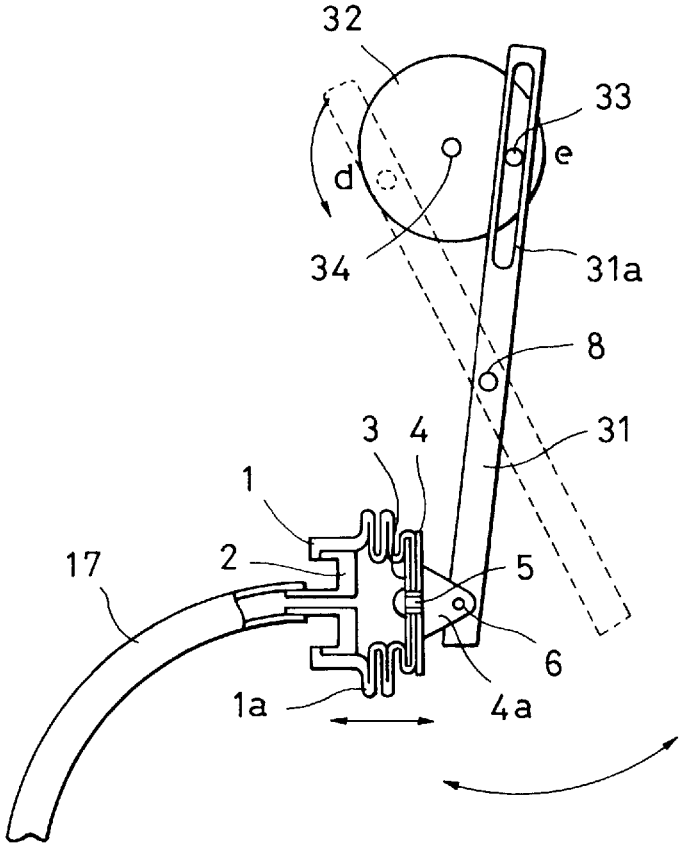
FIG. 8 is a plan view of a pressure reducing mechanism section according to a second embodiment of the present invention.

FIG. 8 is a partial plan view of the pressure reducing section of the second embodiment of the present invention. The components which are the same as those of FIG. 6 are indicated by the same reference numerals. A front view of the suction cup section of this embodiment is omitted since its structure is the same as that of the device shown in FIGS. 6 and 7.

The second embodiment differs from the first one in the method and timing for driving the lever (indicated at 31) and that the lock section is eliminated. An elongated hole 31*a* is provided in the upper end section of the lever 31. A pin 33, which is attached to a disc 32 rotating around a drive shaft 34, is inserted into the elongated hole 31*a*. Therefore, when the pin 33 is at position e shown in the drawing, the bellows section 1*a* of the diaphragm is contracted, and, when the pin 33 is at position d, the bellows section 1*a* is expanded. When the pin 33 is at position e, the suction cups are brought into contact with the stack of sheets, and the disc 32 is rotated to position d, thereby effecting suction. And the pin 33 rotates to the position e; so suction of the suction cups can be released. It is also possible to adopt an operational arrangement in which the disc always starts to rotate from position d, causing it to stop at position d again after one rotation. That is, when the rotation of the disc is started from position d, with the suction cups held in contact with the stack of sheets, the diaphragm, which has been expanded, undergoes a temporary contraction and then expands again, thereby picking up a sheet by suction. When releasing the sheet, the diaphragm performs a similar operation. When an arrangement is adopted in which the sheet is released from the suction cups upon the temporary contraction mentioned above, the sucking action remains in the cancelled state when the diaphragm expands again until it stops. These operations are conducted by controlling the rotation of the drive shaft 34 by a control unit (not shown).

The disc 32 and the suction cups share the same drive source, and driving force is transmitted to the disc 32 from this drive source through a clutch or the like. When there is some structural leeway, individual drive sources may be separately provided for the disc and the suction cups.

Figure 9:
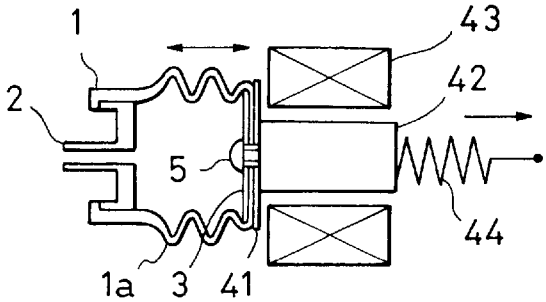
FIG. 9 is plan view of a diaphragm section according to a third embodiment of the present invention.

FIG. 9 illustrates a part of the third embodiment of the present invention. In the drawing, the suction cup section, which have the same construction as that of FIGS. 6 and 7, are omitted. The components which are the same as those of FIGS. 6 and 7 are indicated by the same reference numerals. FIG. 9 partially illustrates a modification of the diaphragm expanding/contracting mechanism. Numeral 41 indicates a member having a function similar to that of the member 4. However, unlike the member 4, the member 41 has no connecting section 4*a*. Instead, an iron core 42 is joined thereto. Numeral 44 indicates an extension spring, which pulls the diaphragm 1 through the intermediation of the iron core 42 to generate a force large enough to expand the bellows section 1*a*. Numeral 43 indicates a coil that is arranged around the iron core 42. By energizing this coil, the iron core is pushed to the left (as seen in the drawing) against the force of the spring 44, thereby contracting the bellows section 1*a*. In this construction, when a sheet is to be picked up by suction, the energization of the coil is stopped so that the diaphragm may be pulled by the spring, and, when the sheet is to be released, the energization of the coil is effected to contract the diaphragm. This operation is effected by controlling the energization of the coil 43 by a control unit (not shown). The spring 44 may also be a compression spring, which is moved to the right (as seen in the drawing) by a magnetic force. Further, it is also possible to adopt a construction having no spring, in which case the diaphragm is moved back and forth by switching the energization polarity.

Figure 10:
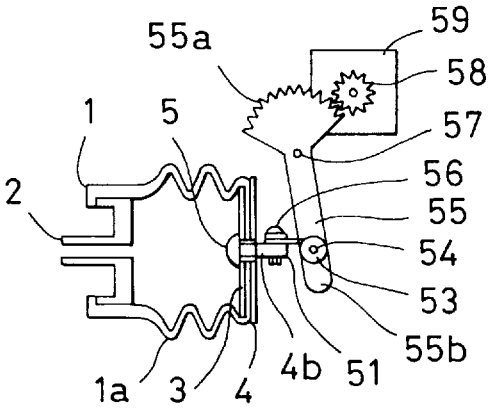
FIG. 10 is a plan view of a pressure reducing mechanism section according to a fourth embodiment of the present invention.
Figure 11:
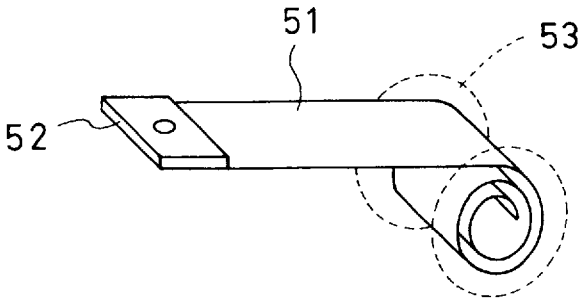
FIG. 11 is a diagram illustrating the structure of a constant-tension spring.

FIGS. 10 and 11 illustrate a part of the fourth embodiment of the present invention. In the drawings, the suction cup section, which have the same construction as that of FIGS. 6 and 7, are omitted. The components which are the same as those of FIGS. 6 and 7 are indicated by the same reference numerals. This embodiment differs from the above-described ones in that the expansion and contraction of the diaphragm is effected by a force transmitted from a drive source through a gear and that the lever and the diaphragm are joined together through the intermediation of a constant-tension spring 51. Numeral 55 indicates a lever which is supported in such a way as to be rotatable around an axle 57. A gear section 55*a* is formed in the upper end section (as seen in the drawing) of the lever 55. This gear section 55*a* is in mesh with a gear 58 that is attached to an output shaft of a drive source 59. FIG. 11 illustrates the constant-tension spring. Numeral 51 indicates the spring; numeral 52 indicates a mounting plate; and numeral 53 indicates a reel around which the spring is wound. Due to this construction, the spring rewinding force is kept constant, without depending on the length of the unreeled portion of the spring. In this embodiment, the reel 53 is attached to the lever 55 through the intermediation of a pin 54, and the mounting plate 52 is fastened to a mounting section 4*b* of the member 4 by means of a screw 56. When the drive source is rotated counterclockwise, the lever 55 rotates clockwise, whereby the forward end 55*b* of the lever 55 causes the bellows section 1*a* of the diaphragm to contract. In this condition, the suction cups (not shown) are pressed against the stack of sheets. Then, the drive source is rotated clockwise, whereby the lever 55 rotates counterclockwise to cause the constant-tension spring 51 to extend. At the same time, the bellows section 1*a* is expanded to reduce the inner pressure of the diaphragm. The strength of the spring 51 is selected such that, when the pressure has been reduced to a desired value, the force generated from the difference in pressure between the interior and exterior of the bellows is balanced with the tension of the spring 51. Accordingly, it is always possible to generate a constant pressure irrespective of the amount of expansion of the bellows or the stop position of the lever. This operation is effected by controlling the drive source 59 by a control unit (not shown). The use of a constant-tension spring is not restricted to this embodiment but is also applicable to other embodiments. When applied to the other embodiments, the constant-tension spring provides the same effect as that of this embodiment.

Figure 12:
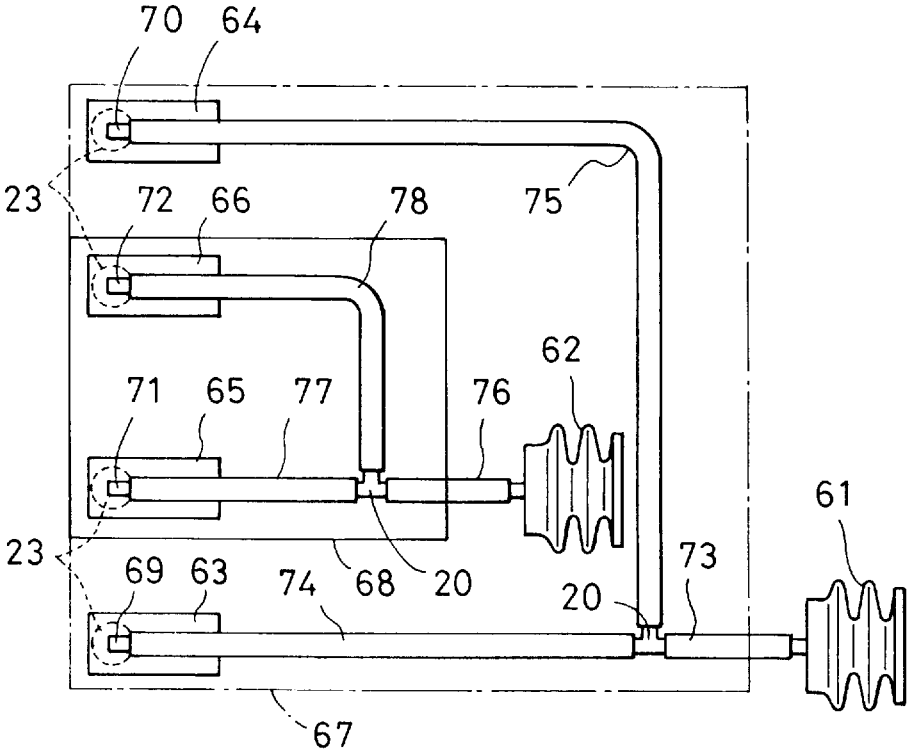
FIG. 12 is a plan view of a piping section in a fifth embodiment of the present invention.

FIG. 12 is a plan view showing the fifth embodiment of the present invention. The components which are the same as those of the above-described embodiments are referred to by the same reference numerals. In this embodiment, an independent piping is provided for each of a plurality of diaphragms, thereby making it possible to pick up sheets of different sizes by suction. In FIG. 12, a first group of hoses 73, 74 and 75 and a second group of hoses 76, 77 and 78 are connected to two diaphragms 61 and 62, respectively. A suction cup 23 is attached to the forward end of each of the hoses 74, 75, 77 and 78 through the intermediation of pipes 69, 70, 71 and 72, respectively. Numerals 63, 64, 65 and 66 indicate suction cup mounting plates to which the pipes 69, 70, 71 and 72 and the suction cups 23 are respectively fastened. These suction cup mounting plates are supported by a support mechanism (not shown) and can be displaced along a dimension perpendicular to the plane of the drawing by means of a drive source (not shown) so as to be movable toward and away from the sheets to be picked up. Numerals 67 and 68 indicate sheets of different sizes. For example, the sheet 67 has a size "43 cm×35 cm", and the sheet 68 has a size "8 in×10 in". The suction cup mounting plates 63, 64, 65 and 66 may be simultaneously moved up and down with respect to the sheet. It is also possible to adopt an arrangement in which all four suction-cup mounting plates or only the suction-cup mounting plates 63 and 64 are moved up and down when picking up the sheet 67 and in which the suction-cup mounting plates 65 and 66 are moved up and down when picking up the sheet 68. The diaphragms 61 and 62 have the same structure as the above-described diaphragm 1 and may be expanded and contracted by a mechanism according to one of the above-described embodiments. Both the diaphragms 61 and 62 may be expanded and contracted by the same mechanism or separately by independent mechanisms. In either case, a control unit (not shown) controls the expanding and contracting mechanism such that the diaphragms are pulled when picking up a sheet, and compressed when cancelling the sucking action, by the expanding/contracting mechanism.

Figure 13A:
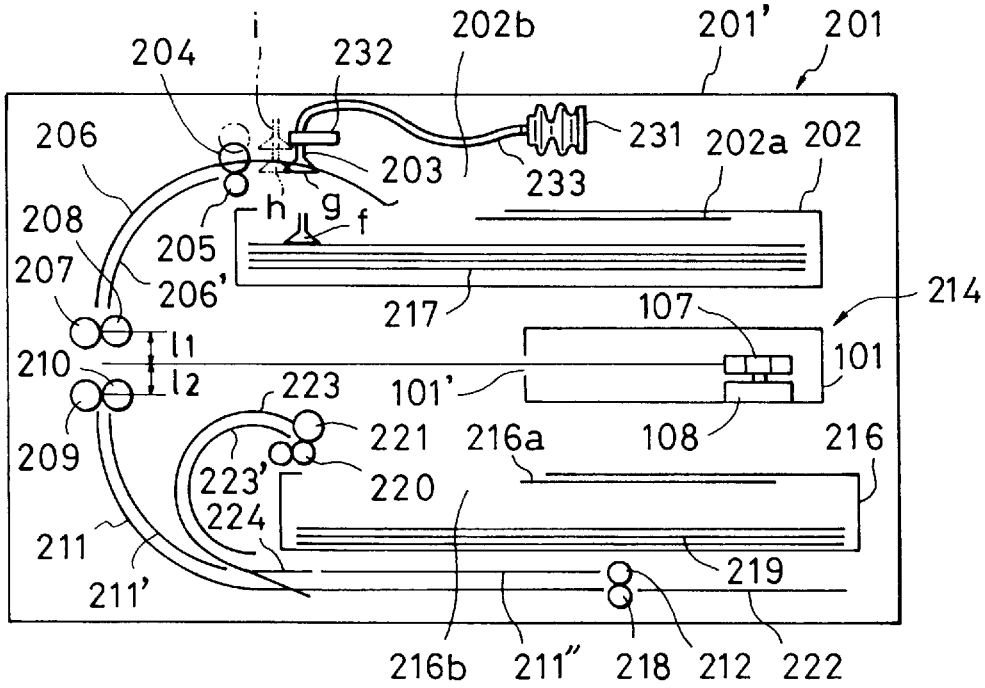
FIGS. 13(*a*) and 13(*b*) are diagrams illustrating an image recording apparatus utilizing the present invention and an optical scanning unit thereof.
Figure 13B:
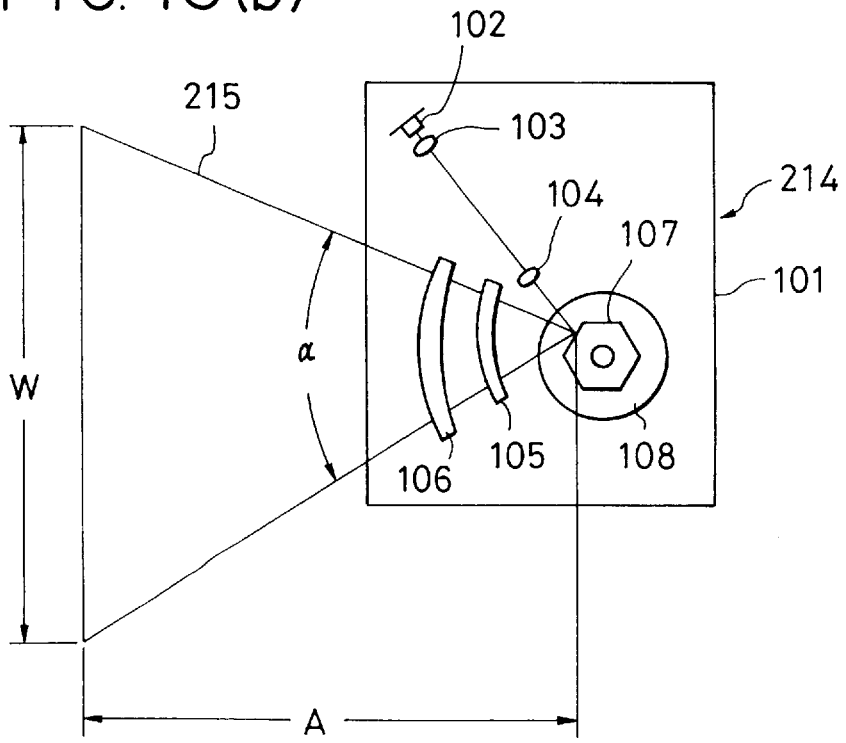

FIGS. 13(*a*) and 13(*b*) illustrate the construction of an image recording apparatus into which a sheet feeding mechanism according to the present invention is incorporated. FIG. 13(*a*) is a front sectional view of the apparatus, FIG. 13(*b*) is a plan view of the optical scanning unit of the apparatus. In the drawing, numeral 201 indicates the body of the recording apparatus, which records digital images, obtained by a medical image generating apparatus, such as a CT or an MRI, on films by using an optical scanning system. Numeral 201' indicates a cover which covers the body 201 in a lighttight fashion and contains a supply magazine 202 containing an unused film 217 and a receive magazine 216 accommodating a used film 219. The supply magazines 202 and the receive magazine 216 are respectively provided with openings 202*b* and 216*b* for allowing films to be put in and taken out. Further, the supply magazine 202 and the receive magazine 216 are respectively equipped with lids 202*a* and 216*a* which can be opened and closed. By closing these lids, the interior of the magazines can be kept lighttight. Therefore, both magazines allow films to be taken out of the apparatus without being exposed.

Numeral 214 indicates an optical scanning unit. In FIGS. 13(*a*) and (*b*), numeral 101 indicates a cover for covering the optical system to protect the same and to prevent intrusion of dust into it. Numeral 101' indicates an opening provided in the cover 101 so as not to interfere with the passage of a light beam 215. Numeral 102 indicates a laser, which emits a light beam having an intensity modulated in accordance with the image data. Numerals 103, 104, 105 and 106 indicate lenses, which convert the characteristics of the light beam to predetermined ones. Numeral 107 indicates a rotating polygon mirror which is caused to rotate at a predetermined speed by a motor 108, thereby performing scanning with the light beam 215 in such a way as to draw a substantially fantailed locus.

In FIG. 13(*a*), numeral 203 indicates a suction cup, which can be moved to positions f, g, h and i shown in the drawing. At position f, it is attached by suction to the topmost one of a stack of sheets. After it has been raised to position g, it moves horizontally to reach position h, where it inserts the film thus picked up into between feeding rollers 204 and 205. By the rotation of the feeding rollers 204 and 205, the inserted film moves downwards (as seen in the drawing) as it is guided by guide plates 206 and 206', until its leading edge is inserted into between sub-scanning rollers 207 and 208. After this, the feeding roller 204 is detached from the sheet and retreats to the position indicated by the broken line in the drawing. The suction cup 203 also retreats to position i and is detached from the film. After this, the sub-scanning rollers 207, 208, 209 and 210 are rotated, whereby the sheet is fed downwards to perform sub-scanning. By irradiating the sheet with the light beam 215, main scanning is effected to form a latent image on the film. In this while, the leading edge of the film passes between guide plates 211 and 211' from the lower side to the right (as seen in the drawing) until it reaches feeding rollers 212 and 218. After the writing has been completed, the sheet is first fed to the right by driving the feeding rollers 212 and 218. When the rear end of the sheet passes a movable guide 224, the movable guide 224 is lowered to the position indicated by the broken line, and the feeding rollers 212 and 218 are reversely rotated. The sheet is then fed to the left, and is guided by guide plates 223 and 223', until it reaches accommodating rollers 220 and 221 to be finally accommodated in the receive magazine 216. This sheet, on which recording has been effected, is developed by another apparatus, thereby forming a visible image on the film.

In the drawing, numeral 231 indicates a diaphragm, which is connected to the suction cup 203 through a hose 233. Numeral 232 indicates a suction cup mounting plate, which is supported by a mechanism that is not shown. The suction cup moving mechanism moves through the route: f→g→h→i by, for example, rotating a cam disc of a cam mechanism. By reversely rotating the cam disc, the suction cup moving mechanism can move through the route: i→h→g→f. The diaphragm expanding/contracting mechanism may be, for example, of the type shown in the first embodiment of the present invention. When the cam shaft 10 of this embodiment is formed coaxially with the above-described suction cup moving mechanism, they can be operated by the same driving source. In that case, the cam for the diaphragm is set such that it is at position a of FIG. 6 before the suction cup reaches position i after moving by way of positions g and h and that it is at position c of FIG. 6 near position f, where it approaches the sheet. In this construction, the diaphragm 231 approaches the sheet 217 in the supply magazine while remaining in the contracted state. After coming into contact with the sheet, the lock is cancelled to pick up the sheet by suction. After the ascent and insertion, the diaphragm is pushed by the lever to cancel the sucking action, and, at the same time, locked in the contracted state so as to be ready for the next picking-up operation.

While this embodiment has been described as applied to an image recording apparatus, the embodiment is also applicable to an image reading apparatus in which the optical scanning unit of a sheet feeding mechanism as shown in FIG. 13 is replaced by a well-known combination of an illumination system and a detection system like a line CCD.

When precision recording or reading is performed by using such an image recording/reading apparatus, a deterioration in image quality occurs when a pump as in the prior art is driven during the recording or reading operation due to the vibration of the pump. In the present invention, however, no vibration is generated during the suction. Thus, by appropriately constructing the apparatus, it is possible for the next sheet to remain standby in the sucked-up state during the recording or reading of the previous sheet, thereby attaining a reduction in cycle time.

Apart from the above, the present invention allows various modifications, as shown below:

The diaphragm may be made of some material other than rubber, such as resin.

Figure 14:
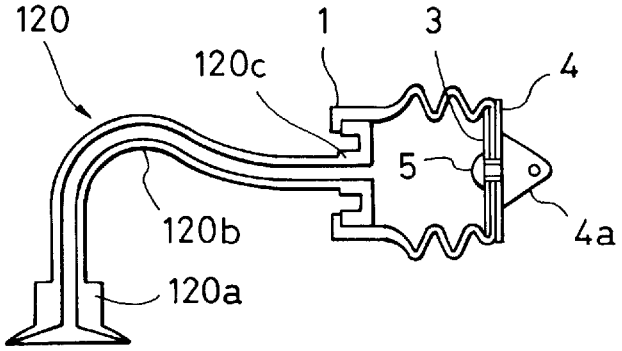
FIG. 14 illustrates an integrally formed structure.

When using resin instead of rubber, the base section, the diaphragm, the hose, the suction cup section, etc., may be entirely or partly combined together so as to be formed as an integral unit. In the example illustrated in FIG. 14, the base, the hose and the suction cup are integrally molded. In the drawing, numeral 120*a* indicates a suction cup section; numeral 120*b* indicates a hose section; and numeral 120*c* indicates a base section. The base section 120*c* is reinforced by a device joint section (not shown). In another possible arrangement, the suction cup section and the hose section are made of a pliant material and the base section is made of a material which ensures the requisite rigidity. These sections may be formed integrally. For example, resins of different levels of hardness, or rubber and resin, may be mixed together to form the sections into an integral unit.

The means for contracting the diaphragm is not restricted to a link mechanism driven by a cam or the like, or magnetic force. It is also possible to contract the diaphragm by means of a resilient member like a spring.

The means for expanding the diaphragm is not restricted to a resilient member like a spring. It is also possible to expand the diaphragm by means of a link mechanism driven by a cam or the like, or magnetic force.

It is also possible to incorporate a device for generating an expanding/contracting force in the diaphragm itself. For example, an integral molding may be possible in which a spring is contained in rubber, or a molding of rubber or resin may be effected such that restoration to the contracted/expanded state is possible.

Figure 15:
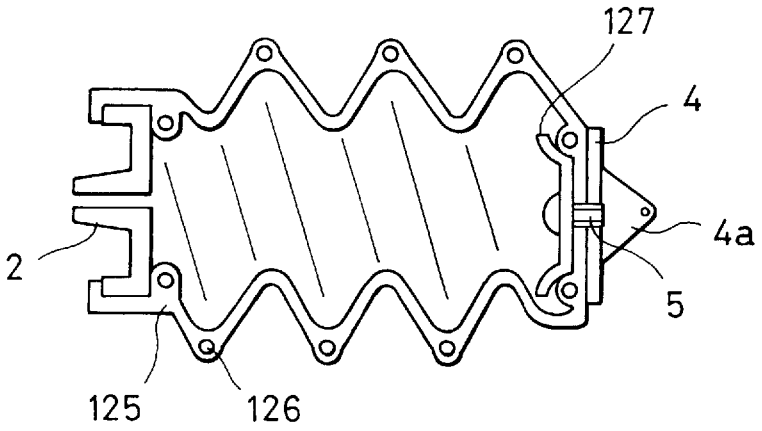
FIG. 15 is a sectional view of a diaphragm integrally formed with a spring.
Figure 16:
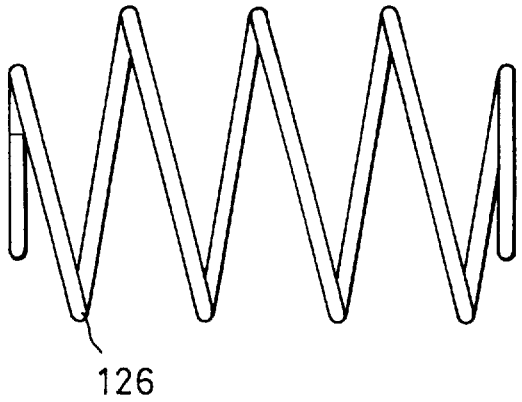
FIG. 16 illustrates a spring.

FIG. 15 shows an example of such a construction. FIG. 15 is a sectional view of a diaphragm 125 containing a compression spring 126 as shown in FIG. 16. Numeral 127 indicates a member that is similar to the circular plate 3. The member 127 also serves to press the spring 126. In this construction, the restoring force of the built-in spring enables the diaphragm to be changed from the contracted to the expanded state.

The recording/reading apparatuses and the sheet picking-up devices of the embodiments described above provide the following advantages:

1. While in the prior art the pump must continue to be driven during the suction, it is substantially unnecessary, in the present invention, to continue a power-driving operation during the suction. Accordingly, no noise is generated during the suction, thereby keeping the apparatus quiet.
2. For the same reason as mentioned above, no vibration is generated during the suction, which means there is no need to provide a vibration isolating mechanism as required in the case in which a pump is used. Thus, the rigidity of the apparatus can be reduced. Accordingly, a less expensive construction is possible. Suction can be continued during the feeding operation in recording, which operation is easily affected by vibration. Thus, the cycle time of the apparatus can be shortened.
3. The construction of the present invention is less expensive as compared with that of the construction using a pump and an electromagnetic valve.
4. The diaphragm has substantially only to perform a cycle of expansion and contraction once with respect to a single sucking action for a single sheet, which means the diaphragm of the present invention can enjoy a longer service life as compared with those diaphragms using a pump which vibrates at high speed. Accordingly, a reduction in running cost can be achieved.
5. The airtight section of the diaphragm includes no sliding parts, which make it difficult to maintain the requisite airtightness in the case of the cylinder type structure. Thus, the diaphragm is inexpensive and enjoys a long service life.
6. By contracting the diaphragm, it is possible to cancel the suction quickly and reliably.

According to the present invention, it is possible for the recording/reading apparatus to be quiet and inexpensive, thereby making it possible to attain a reduction in running cost. It is also possible to achieve a reduction in cycle time.

Further, due to the construction which comprises suction cup moving means that shares the same driving source with the driving means, a further simplification in structure and a further reduction in apparatus price can be achieved. Further, the control operation can be simplified.

Further, due to the construction in which the driving means effects part of the deformation of the container at least by the restoring force of a resilient member, part of the driving operation of the driving means can be effected without using any power.

Due to the construction in which the driving means comprises a means for holding the device in a condition in which the volume of the container can be increased and a means for releasing the holding means, an improvement can be achieved in terms of the precision in timing for generating the sucking condition, thereby realizing a suction control of a still higher level of precision.

Due to the construction in which the driving means deforms the container by using a link mechanism, an improvement in terms of degree of freedom in control can be achieved with a simple construction.

Further, due to the construction in which the driving means deforms the container by using the magnetic force of a magnetic member, a reduction in apparatus size can be achieved, and the control of the sucking force is facilitated.

Further, due to the construction in which the driving means deforms the container by using a gear mechanism, the size of the apparatus can be reduced. Further, by changing the gear combination, the driving force can be easily increased and decreased, so that there is no need to provide slide sections, thereby attaining an improvement in service life.

Further, due to the construction in which the driving means deforms the container by using a constant-tension spring, it is possible to keep the suction pressure constant regardless of the stop position of the mechanism section, etc.

Further, due to the construction in which the driving means deforms the container by using a restoring force of the container itself, the number of parts can be reduced, and a simplification in structure can be attained.

Further, due to the construction in which the suction cup, the container and the interior of the hollow member are entirely or partly combined with each other and formed as an integral unit, the number of parts is reduced and a reduction in cost can be attained. Further, an improvement in airtightness is achieved, and the assembly is facilitated.

Further, due to the construction in which a plurality of suction cups and a plurality of containers are provided and in which connection openings of the plurality of containers and the corresponding air outlet holes of the suction cups are connected together a through hollow pipe, it is possible to effect a suction of a high degree of freedom that is in conformity with the object to be picked up by suction, so that, it is possible, for example, to pick up sheets of different sizes.

What is claimed is:

1. A suction device comprising:

a suction cup for picking up an object by suction force, said suction cup having an air outlet hole;

a container having an inner space that is closed except for an opening for connection with the air outlet hole, said container having a flexible portion, the volume of the inner space being variable through deformation of said flexible portion;

driving means for deformation-driving of said container, said driving means having expanding means including a spring for providing an expansion force for expanding the inner space in said container and providing the suction force, with said expanding means applying the expansion force for expanding the inner space during the picking-up of the object by said suction cup; and a hollow member for connecting the opening for connection with the air outlet hole of said suction cup.

2. A suction device according to claim 1, further comprising suction cup moving means for moving said suction cup.

3. A suction device according to claim 2, wherein said suction cup moving means and said driving means share a same drive source.

4. A suction device according to claim 1, further comprising a resilient member for providing a resilient force by which said driving means executes at least part of the deformation of said container.

5. A suction device according to claim 1, wherein said driving means comprises holding means for maintaining a condition in which the volume of the inner space of said container can be increased, and cancelling means for cancelling the action of said holding means.

6. A suction device according to claim 1, wherein said driving means includes a link mechanism for deforming said container.

7. A suction device according to claim 1, wherein said driving means deforms said container by utilizing a restoring force of said container itself.

8. A suction device according to claim 1, wherein said suction cup, said container and said hollow member are entirely or partly combined with each other and formed as an integral unit.

9. A suction device comprising:

a plurality of suction cups for picking up an object by suction force, each suction cup having an air outlet hole;

a plurality of containers each having an inner space that is closed except for an opening for connection with at least one of the air outlet holes, each container having a flexible portion, the volume of the inner space being variable through deformation of said flexible portion;

driving means for deformation-driving of said plurality of containers, said driving means having expanding means including a spring for providing an expansion force for expanding the inner space in each of said containers and providing the suction force, with said expanding means applying the expansion force for expanding the inner spaces during the picking-up of the object by said suction cups; and a hollow member for connecting each opening with the respective air outlet hole of each said suction cup.

10. A recording/reading apparatus for recording or reading information on sheets, said recording/reading apparatus comprising:

recording/reading means for recording or reading information on sheets;

a suction cup for picking up an object by suction, said suction cup having an air outlet hole;

a container having an inner space that is closed except for an opening for connection with the air outlet hole, said container having a flexible portion, the volume of the inner space being variable through deformation of said flexible portion;

driving means for deformation-driving of said container, said driving means having expanding means including a spring for providing an expansion force for expanding the inner space in said container, with said expanding means applying the force for expanding the inner space during the picking-up of the object by said suction cup; and a hollow member for connecting the opening for connection with the air outlet hole of said suction cup.

11. A suction device according to claim 10, wherein said driving means includes a constant-tension spring for deforming said container.

12. A suction device according to claim 10, wherein said driving means deforms said container by utilizing a restoring force of said container itself.

13. A suction device according to claim 10, wherein said suction cup, said container and said hollow member are entirely or partly combined with each other and formed as an integral unit.

14. A suction device according to claim 10, further comprising suction cup moving means for moving said suction cup.

15. A suction device according to claim 14, wherein said suction cup moving means and said driving means share a same drive source.

16. A suction device according to claim 10, further comprising a resilient member for providing a resilient force by which said driving means executes at least part of the deformation of said container.

17. A suction device according to claim 10, wherein said driving means comprises holding means for maintaining a condition in which the volume of the inner space of said container can be increased, and cancelling means for cancelling the action of said holding means.

18. A suction device according to claim 10, wherein said driving means includes a link for mechanism for deforming said container.

19. A suction device according to claim 10, wherein said driving means includes a magnetic member for deforming said container by using a magnetic force.

20. A suction device according to claim 10, wherein said driving means includes a gear mechanism for deforming said container.

21. A suction device comprising:

a suction cup for picking up an object by suction force, said suction cup having an air outlet hole;

a container having an inner space that is closed except for an opening for connection with the air outlet hole, said container having a flexible portion, the volume of the inner space being variable through deformation of said flexible portion;

driving means for deformation-driving of said container, said driving means providing an expansion force for expanding the inner space in said container and providing the suction force, with said driving means including means for applying a constant elastic force for expanding the inner space during the picking-up of the object by said suction cup; and a hollow member for connecting the opening for connection with the air outlet hole of said suction cup.

22. A suction device according to claim 21, further comprising a resilient member for providing a resilient force by which said driving means executes at least part of the deformation of said container.

23. A suction device according to claim 21, wherein said driving means comprises holding means for maintaining a condition in which the volume of the inner space of said container can be increased, and cancelling means for cancelling the action of said holding means.

24. A suction device according to claim 21, wherein said driving means includes a link mechanism for deforming said container.

25. A suction device according to claim 21, wherein said driving means includes a magnetic member for expanding the inner space by using a magnetic force.

26. A suction device according to claim 21, wherein said driving means includes a gear mechanism for expanding the inner space.

27. A suction device according to claim 21, wherein said driving means includes a constant-tension spring for expanding the inner space.

28. A suction device according to claim 21, further comprising suction cup moving means for moving said suction cup.

29. A suction device according to claim 28, wherein said suction cup moving means and said driving means share a same drive source.

* * * * *

UNITED STATES PATENT AND TRADEMARK OFFICE

CERTIFICATE OF CORRECTION

PATENT NO. : 5,884,907

DATED : March 23, 1999

INVENTOR(S) : Ohkoda

It is certified that error appears in the above-identified patent and that said Letters Patent is hereby corrected as shown below:

[56] REFERENCES CITED:

FOREIGN PATENT DOCUMENTS, "60118550" should read --60-118550--.

Signed and Sealed this

Eleventh Day of January, 2000

*Attest:*

*Attesting Officer*

Q. TODD DICKINSON

*Acting Commissioner of Patents and Trademarks*